United States Patent [19]

Yamamoto

[11] Patent Number: 5,062,729

[45] Date of Patent: Nov. 5, 1991

[54] COMBINATION OF CAR WASHING BRUSH AND DUSTER UTILIZING FEATHER OF WATERFOWLS

[76] Inventor: Mitsuhiro Yamamoto, 1487-8, Ooaza Shiwanini, Shiwa, Higashi Hiroshima-shi, Hiroshima, Japan

[21] Appl. No.: 523,396

[22] Filed: May 14, 1990

[51] Int. Cl.[5] ..... A46B 11/04; A47L 13/22

[52] U.S. Cl. ..... 401/287; 401/289; 401/268

[58] Field of Search ..... 401/289, 283, 282, 287, 401/268, 140; 15/234, DIG. 2, 53 A

[56] References Cited

U.S. PATENT DOCUMENTS

| | | | |
|---|---|---|---|
| 843,114 | 2/1907 | Snevely | 15/234 |
| 843,590 | 2/1907 | Dunn | 15/234 X |
| 846,614 | 3/1907 | Pugh | 401/289 X |
| 1,142,911 | 6/1915 | Riddiford | 401/289 |
| 2,214,989 | 9/1940 | Brand | 15/234 X |
| 2,373,050 | 4/1945 | Penick | 401/283 X |
| 4,740,627 | 8/1988 | Lamore | 15/234 |

FOREIGN PATENT DOCUMENTS

| | | | |
|---|---|---|---|
| 215664 | 5/1924 | United Kingdom | 401/289 |

*Primary Examiner*—Danton D. DeMille
*Attorney, Agent, or Firm*—Koda and Androlia

[57] ABSTRACT

A car washing brush which can also be used as a duster removing dust on a car body is disclosed. Feather of waterfowls are utilized. A wax spray is applied to the feather of waterfowls when used for washing a car with water.

2 Claims, 2 Drawing Sheets

COMBINATION OF CAR WASHING BRUSH AND DUSTER UTILIZING FEATHER OF WATERFOWLS

BACKGROUND OF THE INVENTION

1. Field of the Invention

This invention relates to combination of a car washing brush and duster utilizing feather of waterfowls. This combination of a car washing brush and duster removes dust on a car body and can be used for a car wash with water.

2. Description of the Prior Art

Generally, a duster for automobiles is only used for removing dust on car bodies and utilizes feather. Feather usually have no good water resistance nor endurance, so that a car washing brush used with water utilizes bundled synthetic fibers, each having a flat shape.

SUMMARY OF THE INVENTION

Accordingly, the present invention provides a combination of a car washing brush and duster, wherein feather of waterfowls such as a house duck or the like are particularly applied to realize a feather planting construction which will not deteriorate the feather with water, wax is sprayed thereto upon applications so as to cover the feather with water proof coats, water is supplied through a pipe of a grip, softness of the feather will not damage a car body when the car is being washed, and this brush can be used as a duster after having a water supplying hose detached and then after getting dried.

DETAILED DESCRIPTION OF THE PREFERRED EMBODIMENTS

Figure 1:
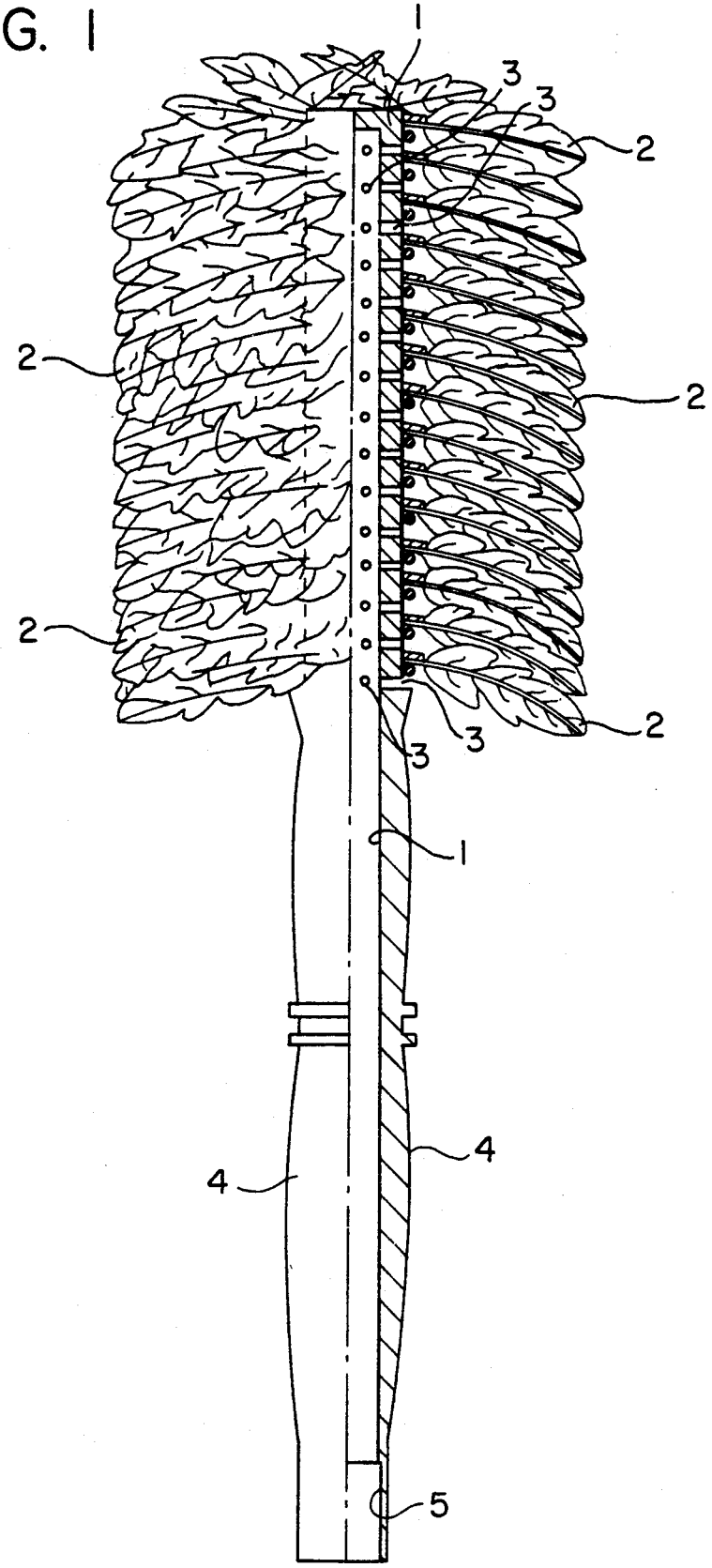
FIG. 1 is a partially taken-away sectional view showing one embodiment of the present invention.
Figure 2:
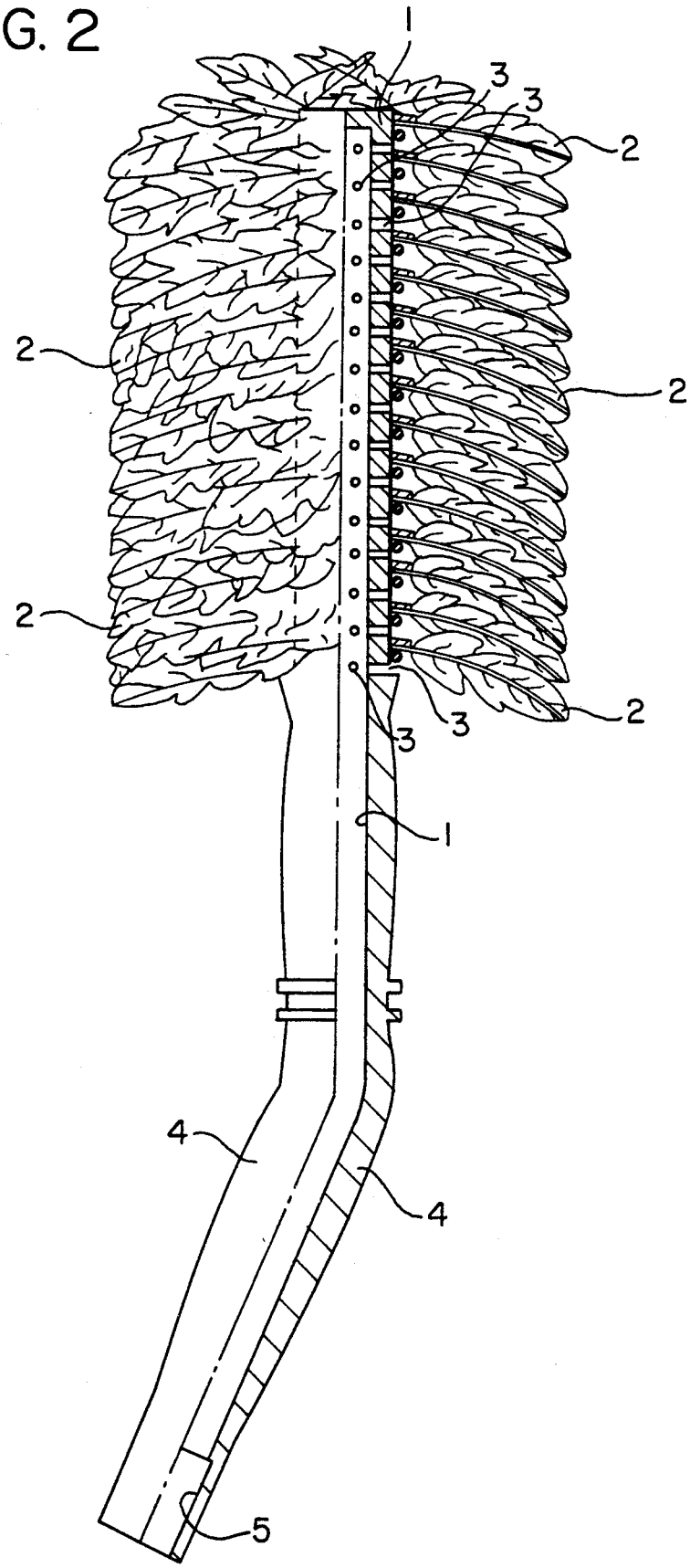
FIG. 2 is a partially taken-away sectional view showing another embodiment of the present invention.

An embodiment of the present invention is described in details hereinafter. A stem (1) is made of a pipe. A dusting portion composed of feather (2) of waterfowls are arranged on a distal half of this stem (1). A number of water fountain holes (3) are also formed on the distal half of this stem (1). A proximal half of the stem (1) is served as a grip (4), and an insertion hole (5) for a water hose is provided at a proximal end of the grip (4).

The stem (1) may be a little bent at a proximal end of the dusting portion.

Operations of the present invention are described hereinafter. It can be used as an usual duster when it is merely used with the proximal grip (4) held by a hand. When a water hose is inserted into the insertion hole (5) of the proximal end and water is supplied through the hose, water comes out of a lot of the water fountain holes (3). Softness of the feather will realize that a car body can be washed without damages thereon.

In this case, the feather of waterfowls having good water resistance are applied. In addition, an attached wax spray is sufficiently applied to the feather to assure good water resistance, so that even a long time washing does not deteriorate the feather.

The sprayed wax gives glazing effects to the car body, so that the car will not need to be waxed after the car wash.

The stem bent a little as described above is easy to use.

As described above, the present invention is composed by using the feather of waterfowls, and the wax spray is used for reinforcing its water resistance when it is used for washing a car with water. The combination of a car washing brush and duster made of waterfowl feather of the present invention gives a soft contact to a car body and prevents any damage to the car body. When the water hose is detached and the brush gets dried, it can also be used as an usual duster.

I claim:

1. A combination of a car washing brush and duster utilizing feather of waterfowls comprising;

a stem made of a pipe and having distal and proximal halfs, said distal half of said stem having a number of water fountain holes, and said proximal half being served as a grip;

a dusting portion provided substantially on said distal half of said stem and made of feather of waterfowls; and a water hose insertion hole provided at a proximal end of said proximal grip;

wherein wax is sprayed to said feather of waterfowls upon applications.

2. A combination of a car washing brush and duster utilizing feather of waterfowls according to claim 1, wherein said stem is a little bent nearby a proximal end of said dusting portion.

* * * * *